US007033194B1

(12) United States Patent
Le Beau

(10) Patent No.: US 7,033,194 B1
(45) Date of Patent: Apr. 25, 2006

(54) STANDARDIZED ELECTRICAL TERMINAL

(75) Inventor: Howard Stephen Le Beau, Shelby, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 11/010,403

(22) Filed: Dec. 14, 2004

(51) Int. Cl.
*H01R 13/28* (2006.01)

(52) U.S. Cl. ..... 439/290; 439/291; 439/949

(58) Field of Classification Search ..... 439/290, 439/291, 949
See application file for complete search history.

(56) References Cited

U.S. PATENT DOCUMENTS 2,389,115 A * 11/1945 Anderson ..... 439/290
2,554,876 A 5/1951 Olson
2,762,022 A 9/1956 Benander et al.
2,785,387 A 3/1957 Batcheller
3,083,345 A 3/1963 Scheller
3,178,669 A * 4/1965 Roberts ..... 439/291
3,188,600 A * 6/1965 Woofter et al. ..... 439/290
3,202,954 A 8/1965 Kinkaid
3,514,740 A 5/1970 Filson
3,634,811 A * 1/1972 Teagno et al. ..... 439/290
3,789,343 A * 1/1974 Hirokawa et al. ..... 439/291
4,061,406 A * 12/1977 Kunkle ..... 439/291
5,108,304 A 4/1992 Bogiel et al.
5,577,928 A * 11/1996 Duclos ..... 439/290

FOREIGN PATENT DOCUMENTS

DE 3734595 A1 * 4/1989

* cited by examiner

*Primary Examiner*—Tulsidas C. Patel
*Assistant Examiner*—Vladimir Imas
(74) *Attorney, Agent, or Firm*—Daniel R. Edelbrock

(57) ABSTRACT

A first electrical wire terminal is designed to mate with a second, identical electrical wire terminal rotated ninety degrees about a longitudinal axis and turned to face the first terminal. In one embodiment, the first and second terminals each have an insertion member and a semi-rectangular receiving member forming a slot. The slot has a bowed side providing a resilient contact surface biased against the insertion member. The insertion member and the receiving member are arranged in a pattern such that they have adjacent edges with the insertion member extending perpendicular to the receiving member. The receiving member includes an aperture for accepting a projection on the insertion member to help maintain the electrical contact. In another embodiment, each terminal has a pair of insertion members and a pair of receiving members. The pairs are arranged in a box-like pattern with the insertion members having adjacent edges and the receiving members having adjacent edges as well.

20 Claims, 4 Drawing Sheets

STANDARDIZED ELECTRICAL TERMINAL

BACKGROUND OF THE INVENTION

1. Field of the Invention

This invention relates in general to electrical terminals for conductive attachment to the ends of electrical wires, and more specifically to terminals that can insert into or receive electrical terminals having the identical structural design for the purpose of completing an electrical circuit.

2. Discussion of Related Art

Typical electrical terminal designs include either male or female structural characteristics to enable the terminals to mate with each other and complete an electrical connection. However, hermaphrodite-type electrical contacts are also known in the art. These terminals are capable of mating with terminals of similar structure. Some are rather complex, making them costly to produce. Others are simple in construction, but have reliability issues. The contact surface area, frictional engagement forces, and the ability to be quickly connected and disconnected through many cycles and still provide a quality electrical engagement are all factors that need to be considered in the use of these terminals. Despite the variety of terminals available, it seems a need still exists for a design providing increased electrical contact surface area and reliable securement, yet low insertion force and minimal production cost.

SUMMARY OF THE INVENTION

Accordingly, it is an object of this invention to provide an electrical terminal that can physically and electrically mate with a terminal identical to itself in a compact and reliable manner.

Another object of the invention is to utilize both male and female characteristics in a single one-piece electrical terminal to form multiple contact surfaces and thereby increase electrical contact surface area.

A further object of the invention is to enable these hermaphrodite terminals to be stamped and formed in relatively small sizes from thin material for economical production.

In carrying out this invention in the illustrative embodiment thereof, a one-piece electrical terminal has at least one contact section in a partially rectangular shape forming a slot. One side of the slot is bowed inward and deflectable. The terminal also has at least one contact section in the shape of a prong or arm. The slot and arm are positioned side-by-side at right angles to each other. The arm is sized to be received by the slot of an identical terminal, with the bowed side of the slot deflecting outward but remaining resiliently biased into contact with the arm. In an embodiment wherein the terminal has two arms and two slots, the arms and slots form a four-sided figure or box-like shape.

Rotating or turning a first terminal ninety degrees about its longitudinal axis, and inverting it to face a second, identical terminal on the same axis, enables the arm or arms of each terminal to insert into the slot or slots of each terminal, completing a compact electrical connection. In a single-type terminal design, there are four relatively large electrical contact surfaces formed by opposite sides of each arm of each terminal engaging a slot of each terminal. In the dual-type terminal, there are eight large electrical contact surfaces, since each terminal has two slots and two arms. These reliable, full contact surfaces exist regardless of whether design tolerances are off since the bowed sides of the slots are resilient and biased into contact with the arms.

There are also projections on the arms positioned to fit into apertures through sides of the slots when the terminals are mated to provide a releasable lock, ensuring the electrical connection is maintained.

Therefore, one part can be used in two different functional applications, for example, in both male and female electrical connectors. As a result, the part design is simplified and uniform, since each terminal requires the same, single blank and formation process. This requires less tooling and causes a reduction in inventory to a sole part pool. The compact construction and multiple contact surfaces enable the thickness and relative size of the terminals to be kept small, minimizing material costs. Only a single fulcrum is needed on a female structural part of the terminal, as opposed to the more typical double fulcrums in terminals of this size. There is a low insertion force because the terminals slide together without obstruction on a straight axis and the thinness of the material allows the arms and bowed sides of the slots to easily deflect.

BRIEF DESCRIPTION OF THE DRAWINGS

This invention, together with other objects, features, aspects and advantages thereof, will be more clearly understood from the following description, considered in conjunction with the accompanying drawings.

DETAILED DESCRIPTION OF THE ILLUSTRATED EMBODIMENTS

Figure 1:
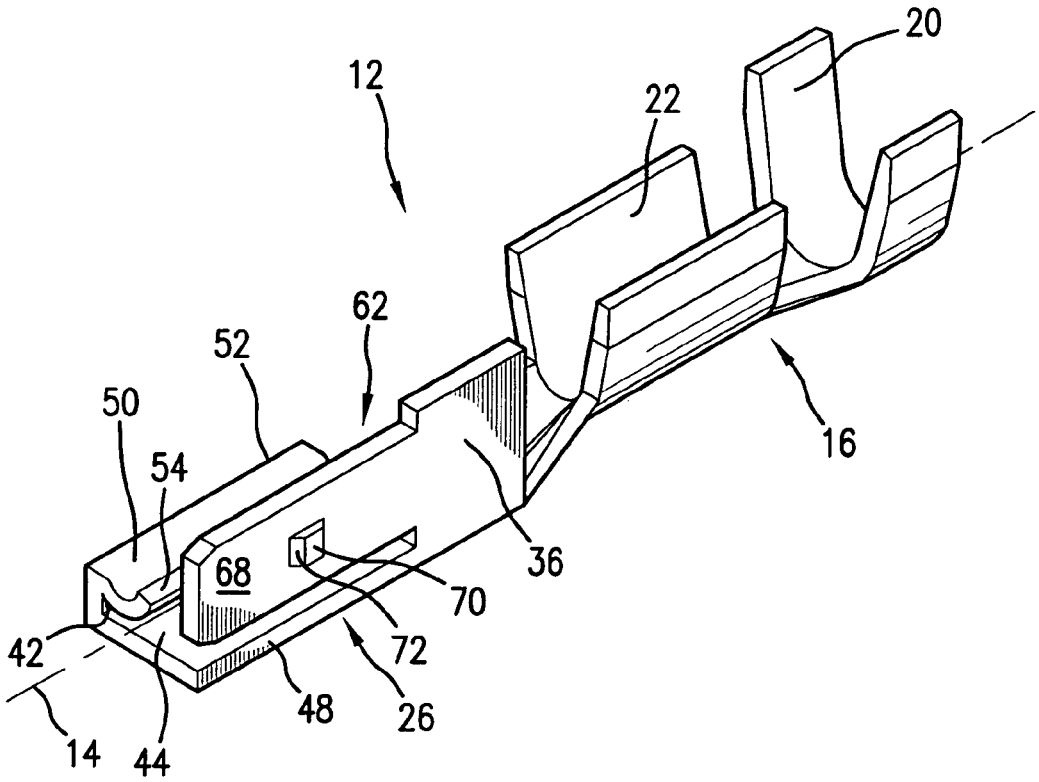
FIG. 1 is perspective view as seen from a mating end of an electrical terminal according to the present invention.
Figure 2:
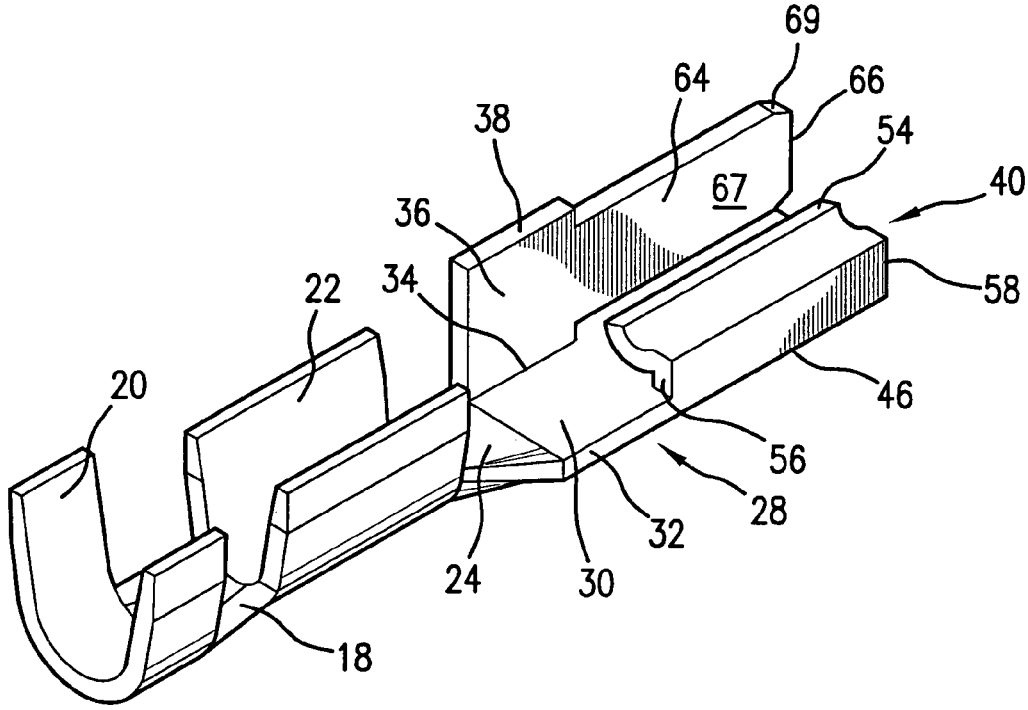
FIG. 2 is a perspective view as seen from a wire connect end of the terminal of FIG. 1.

Referring now to FIGS. 1 and 2, a terminal 12 according to the present invention comprises a one-piece component stamped into a precise pattern from an electrically conductive, thin sheet of metal such as brass. The stamped component is then folded, bent or otherwise formed into a structure for physical and electrical attachment to the end of an electrical wire. The actual size of the terminal 12 is approximately five times smaller than illustrated. The structure has a longitudinal axis 14 and includes a wire connect part 16. The wire connect part 16 has a first segment 18 having crimp tabs 20 for clamping onto a still-insulated portion of the wire end, and crimp tabs 22 for clamping onto an insulation-stripped portion of the wire end and making electrical contact with the wire. A second segment 24 of the wire connect part 16 is generally planar in configuration and merges into a terminal mating part 26.

The terminal mating part 26 has a support section 28 integral with the second segment 24 of the wire connect part 16. The support section 28 serves to both space and join the electrical mating elements of the terminal from and with the wire connect part. A base panel 30 extends parallel to the longitudinal axis 14. The base panel 30 has a first periphery 32 and a second periphery 34. A side panel 36 extends upward (as the terminal is oriented in FIGS. 1 and 2) at a right angle from the second periphery 34 of the base panel 30. The side panel has an upper periphery 38.

The terminal mating part 26 has a first electrical contact section 40 forming a semi-rectangular receiving member or slot 42. This section imparts a female structural characteristic to the terminal. The first contact section 40 integrally extends from the base panel 30 along the longitudinal axis 14. The slot 42 has a wider side 44 having a first edge 46 contiguous with the first periphery 32 of the base panel 30 and a second edge 48 contiguous with the second periphery 34 of the base panel. A narrower side 50 of the slot is closely spaced from the wider side 44 in a substantially parallel plane and has a first edge 52 and a second edge 54. The first edge 52 is joined to the first edge 46 of the wider side 44 by a short wall 56 perpendicular to each side. The narrower side 50 of the first contact section 40 extends a considerable length from the short wall 56 to the second, free edge 54, forming the slot 42 between the wider and narrower sides. The narrower side 50 is curved or bowed inward toward an interior of the slot 42. The material is thin enough to provide resiliency to the bowed narrower side 50, enabling it to flex or deflect relative to the wider side 44 in some circumstances. The slot 42 has a receiving end 58. At the receiving end 58, a forward edge of the bowed narrower side 50 adjacent an entrance to the slot 42 has a small radius. A rectangular aperture 60, hidden in FIGS. 1 and 2 but illustrated in FIG. 3, is cut through a generally central region of the wider side 44 of the slot 42.

A second electrical contact section 62 of the terminal mating part 26 extends from the side panel 36 along the longitudinal axis 14. This section imparts a male structural characteristic to the terminal. The second contact section 62 is an insertion member in the shape of a wide, flat prong or arm 64. The arm 64 is about as long as the slot 42 and forms a right angle with the slot. More specifically, it forms a right angle with the second edge 48 of the wider side 44 of the slot. The slot 42 and arm 64 together form an L-shaped terminal mating part 26. The arm 64 has a free, insertion end 66, an inward surface 67 facing the slot, and an outward surface 68 facing away from the slot or contact section 40. The insertion end 66 is located generally in the same plane as the receiving end 58 of the slot 42, and includes beveled outer borders 69. The arm is sized to be slightly thinner than the length of the short wall 56 of the slot or, in other words, thicker than the shortest distance between the wider side 44 and bowed narrower side 50 of the slot. In a central region of the surface 68, a projection 70 protrudes from the surface 66. The projection 70 has chamfered or ramped perimeters 72 and is sized slightly smaller than the aperture 60 through the wider side 44 of the slot 42.

Figure 3:
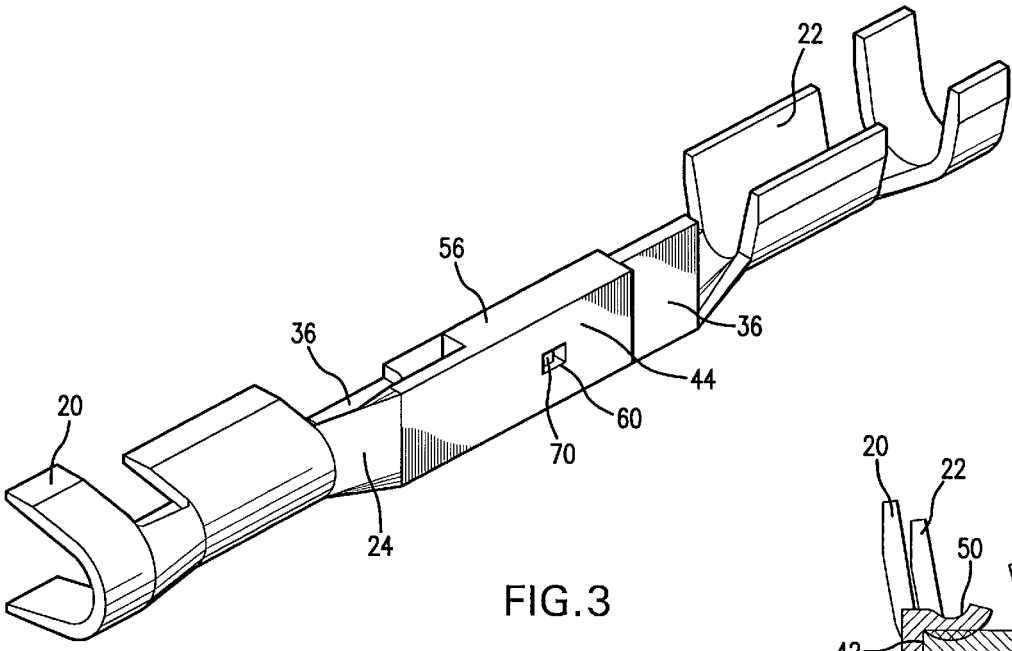
FIG. 3 is a perspective view depicting how the electrical terminal of FIG. 1 would mate with an identical terminal.
Figure 4:
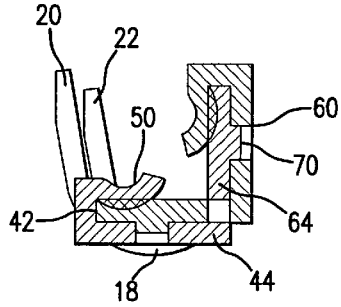
FIG. 4 is a vertical cross-section taken through a central area of the mated terminals of FIG. 3, looking into the drawing sheet.

FIGS. 3 and 4 depict how a terminal 12 would mate with an identical terminal 12. An identical electrical terminal matched in spatial orientation with terminal 12 would be rotated ninety degrees clockwise about the longitudinal axis 14. The identical terminal would then be turned or reversed such that its insertion member and receiving member face and line up with the receiving end 58 of the slot 42 and the insertion end 66 of the arm 64, respectively. As the terminals are mated, the bowed, narrower side 50 of the slot 42 deflects to receive the arm and remains pressed against the arm 64 due to the resiliency and curved shape. The projection 70 on the outward surface 68 of the arm 64 of the terminal 12 is positioned to snap into the aperture in the wider side of the slot of the identical terminal when the arm is completely inserted in the slot. The resiliency of the arm, the guiding action of the beveled outer borders 69 of the arm insertion end 66, the small radius on the forward edge of the bowed narrower side 50 of the slot, and the chamfered perimeters 72 of the projections enable smooth, low-force operation. Simultaneously, the aperture 60 in the wider side 44 of the slot 42 of the terminal 12 accepts the projection on the outward surface of the arm of the identical terminal.

The terminals are thereby securely mated with minimal insertion force and reliably maintained contact surfaces. There are four major electrical contact surfaces, as best illustrated in the cross-sectional view of FIG. 4. Each inward surface 67 and outward surface 68 of each arm 64 contacts the slot sides in a relatively large surface area. The bowed, narrower sides 50 of the slots 42 would be deflected slightly away from the wider surfaces 44. FIG. 4 depicts the at-rest or original positions of the sides 50 for clarity. However, in actuality, the sides 50 would be deflected away from the wider surfaces 44 of the slots 42 by the arms 64, so the inherent spring bias of the sides 50 would maintain reliable electrical contact with the arms. In addition, the fit between the arms and slots, though represented as being close and tight, would not be without the inevitable gaps due to manufacturing tolerances. It should also be noted that the cooperating latch or lock elements, comprising apertures 60 and projections 70, might be eliminated in some deployments. For example, some types of connector housings that receive the terminals may have sufficient elements for assuring and maintaining the positions of the terminals.

Figure 5:
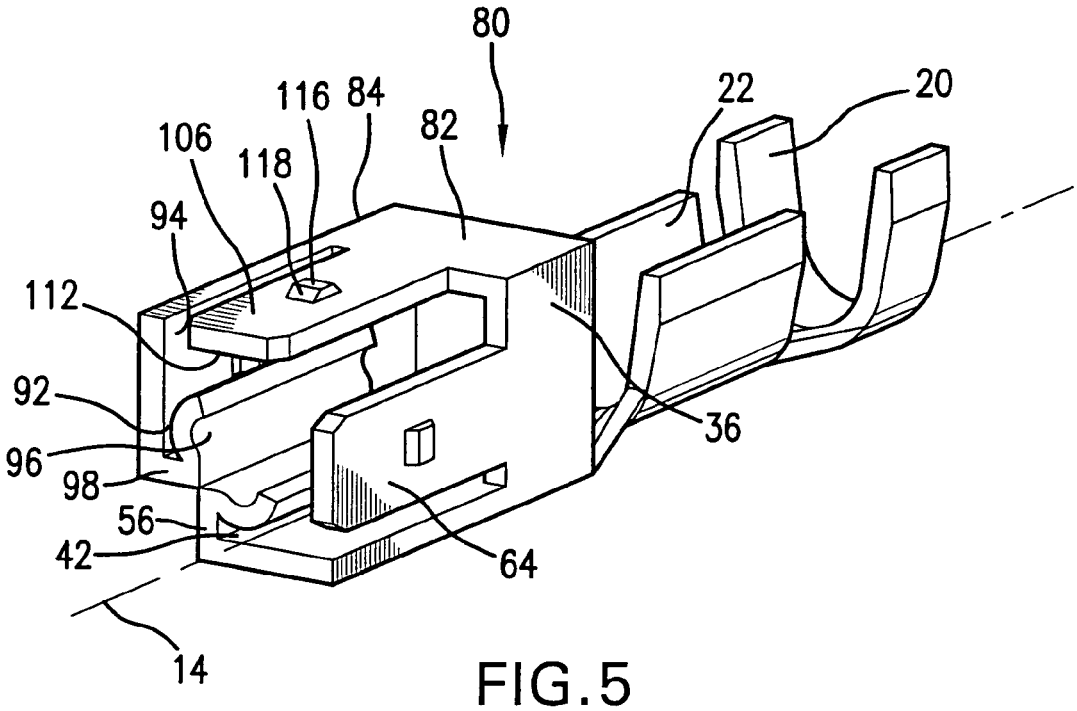
FIG. 5 is a perspective view as seen from a mating end of an electrical terminal according to the present invention expanded to include dual contact features.
Figure 6:
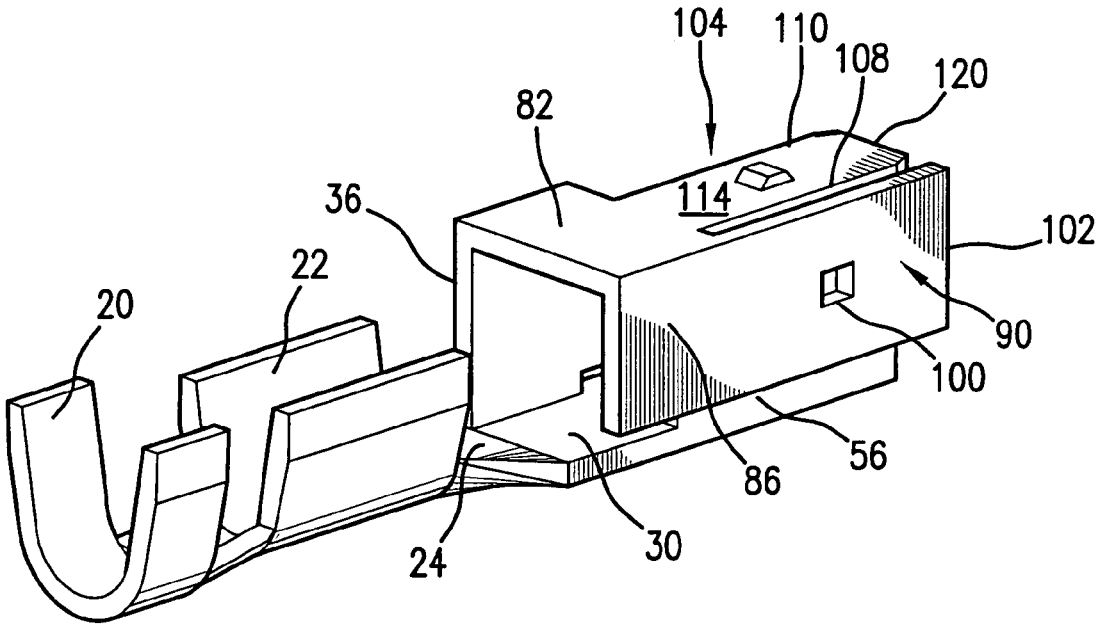
FIG. 6 is a perspective view as seen from a wire connect end of the terminal of FIG. 5.

As illustrated in FIGS. 5 and 6, the invention can be expanded to include a dual-type terminal 80 having the same features and advantages as the previously described terminal 12. The terminal 12 would essentially be characterized as a single-type terminal, having one male contact or insertion member 64 and one female contact or receiving member 42. The dual-type terminal 80 doubles the number of contacts, and therefore doubles the number of contact surfaces. Similar features are referenced by the previous reference numbers. The support section 28 further includes a top panel 82 extending at a right angle from the upper periphery 38 of the side panel 36, back across the longitudinal axis 14, to a periphery 84 distal from the side panel 36. A second side panel 86 extends at a right angle downward from the top panel periphery 84 to a position close to but outward from the base panel 30.

In the dual-type terminal, there is a third contact section 90 extending along the longitudinal axis 14 from the second side panel 86. The third contact section 90 is formed into a semi-rectangular receiving member or slot 92 in the same manner as the first contact section 40 is formed into the slot 42. This includes a wider side 94 contiguous with the second side panel 86 and a curved or bowed narrower side 96 extending in a generally parallel plane to the wider side 94. A short wall 98 is perpendicular to, and connects, the two sides. The third contact section also includes a generally rectangular aperture 100 through a central region of the wider side 94 and a receiving end 102 distal from the second side panel 86. The slot 92 of the third contact section 90 extends at a right angle from the slot 42 of the first contact section 40, with the short wall 56 of the first contact section adjacent to the corresponding short wall 98 of the third contact section but in a perpendicular plane. This has the added benefit of providing a built-in indexing feature to the terminal 80. The terminal can only be inserted into a terminal accommodating cavity in a connector housing in the correct alignment if the cavity has a protrusion taking up the space partially bounded by the short walls 56 and 98.

There is also a fourth contact section 104 in the dual-type terminal. The fourth contact section 104 forms an insertion member or arm 106 similar to the arm 64 of the second contact section 62. The arm 106 extends from the top panel 82 along the longitudinal axis 14 of the terminal 80. The arm 106 is perpendicular to the wider side 94 of the slot 92 and has a first edge 108 closely spaced from the slot wider side 94. The arm 106 is also perpendicular to the arm 64 of the second contact section 62, but a second edge 110 of the arm 106 is spaced relatively further apart from the arm 64. The arm 106 includes an inward surface 112 facing an interior space of the terminal and an outward surface 114. The outward surface 114 has a projection 116 protruding from a central region of the arm. The projection 116 has chamfered or beveled perimeters 118. The arm 106 has an insertion end 120 distal from the top panel 82.

Figure 7:
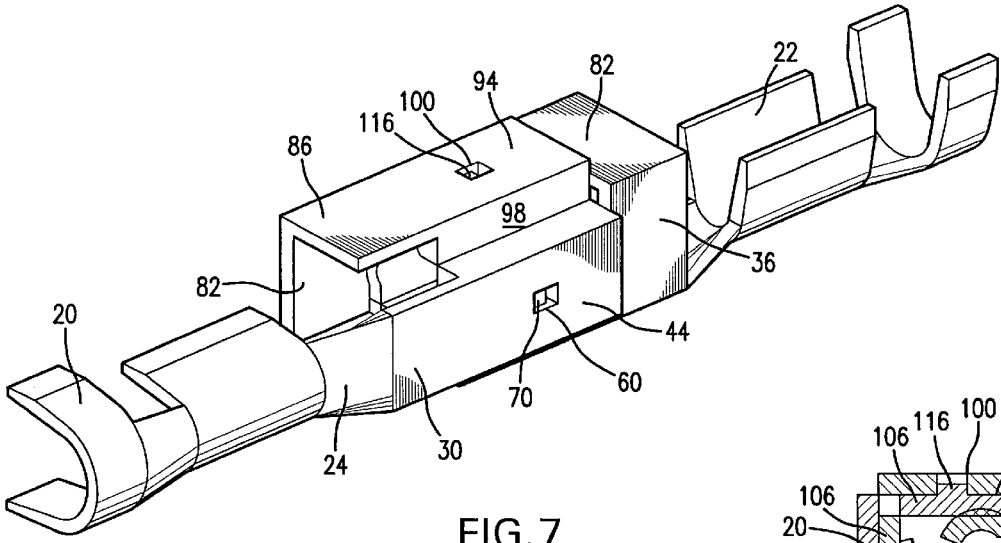
FIG. 7 is a perspective view depicting how the electrical terminal of FIG. 5 would mate with an identical terminal.
Figure 8:
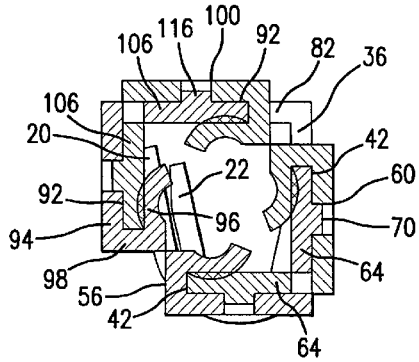
FIG. 8 is a vertical cross-sectional view through a central area of a pair of mated terminals as depicted in FIG. 7, illustrating electrical contact surfaces.

The four contact sections form a four-sided shape or box-like terminal mating part. If arranged to face an identical terminal by rotating a similarly orientated identical terminal ninety degrees about the longitudinal axis 14 and inverting or turning the identical terminal such that the terminal mating parts can be electrically mated, as demonstrated in FIG. 7, the two terminals would provide eight major electrical contact surfaces. This is depicted in vertical cross-section in FIG. 8. Each inward surface 67, 112 and outward surface 68, 114 of each of the four arms 64, 106 of the mated terminals provide a relatively long and wide contact area with the slot sides 44, 50, 94 and 96. The electrical contact surfaces engage each other substantially along the entire lengths of the contact sections. The engagement is always continuous, ensured by the resiliency and bow-shape of the narrower slot sides 50, 96. The frictional forces combined with the engagement of the projections 70, 116 and apertures 60, 100, deliver a reliable connection.

Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

What is claimed is:

1. An electrical terminal comprising:

at least one male characteristic in the form of a flat arm; and at least one female characteristic in the form of a receiving member separated from the male characteristic, the receiving member having two spaced apart sides, one of the sides being wider than an other of the sides, such that the wider side has an edge extending past an edge of the other side;

wherein the flat arm is positioned to form a right angle with the wider side of the receiving member at the extending edge.

2. The electrical terminal of claim 1 wherein there is a first male characteristic, a first female characteristic, and the right angle is a first right angle arrangement, and further comprising a second male characteristic and a second female characteristic, the second male and female characteristics having adjacent edges and forming a second right angle arrangement.

3. The electrical terminal of claim 2 wherein the first and second right angle arrangements together form a box-like configuration.

4. The electrical terminal of claim 3 wherein the first and second male characteristics are adjacent to each other and the first and second female characteristics are adjacent to each other in the box-like configuration.

5. The electrical terminal of claim 1 wherein the receiving member is a slot formed by the two sides.

6. The electrical terminal of claim 5 wherein the other side is curved toward the wider side to ensure surface contact with an arm of an identical terminal.

7. The electrical terminal of claim 5 wherein the wider side of the slot includes an aperture in a central region of the wider side, and the arm includes a projection in a central region of the arm facing away from the slot.

8. An electrical terminal comprising:

a wire connect part having a first segment for connection to an electrical wire and a second segment;

a support section joined to the second segment;

a first contact section extending from the support section, the first contact section configured as a slot with a wider side having first and second edges, a narrower side closely spaced from the wider side and having first and second edges, the wider side and narrower side being joined at their first edges by a short wall perpendicular to each side; and a second contact section extending from the support section in the same direction as the first contact section, the second contact section being configured as an arm with a free end distal from the support section, the arm turned at a right angle relative to the slot at the second edge of the wider side of the first contact section.

9. The electrical terminal of claim 8 further comprising an aperture in a central region of the wider side of the slot and a projection in a central region of the arm facing away from the slot.

10. The electrical terminal of claim 8 wherein the narrower side of the slot is bowed toward the wider side of the slot.

11. The electrical terminal of claim 8 further comprising a third contact section extending from the support section, the third contact section configured as a slot with a wider side having first and second edges, a narrower side closely spaced from the third contact section wider side and having first and second edges, the third contact section wider side and narrower side being joined at their first edges by a short wall perpendicular to each side, the third contact section being positioned at a right angle relative to the first contact section with the short walls of the first and third contact sections adjacent to and perpendicular to each other.

12. The electrical terminal of claim 11 further comprising a fourth contact section extending from the support section in the same direction as the third contact section, the fourth contact section being configured as an arm with a free end distal from the support section, the arm turned at a right angle relative to the slot of the third contact section at the second edge of the wider side of the third contact section.

13. The electrical terminal of claim 12 wherein the arms of the second and fourth contact sections have adjacent edges and are positioned at right angles relative to each other, such that the first, second, third and fourth contact sections together form a box-like shape.

14. The electrical terminal of claim 12 wherein the narrower sides of the first and third contact sections are bowed toward the wider sides of the first and third contact sections, respectively.

15. The electrical terminal of claim 12 wherein the first, second, third and fourth contact sections are integral with the support section.

16. The electrical terminal of claim 12 further comprising apertures located in a central region of the wider sides of the first and third contact sections, and projections protruding from central regions of the second and fourth contact sections facing away from the slots.

17. An electrical wire connection system comprising:

a first wire terminal having a longitudinal axis, and an insertion member and a receiving member in a side-by-side pattern, the insertion member having an insertion end and the receiving member having a receiving end; and a second wire terminal having a longitudinal axis, and an insertion member and a receiving member arranged in a side-by-side pattern identical to the side-by-side pattern of the first terminal, the insertion member of the second terminal having an insertion end and the receiving member of the second terminal having a receiving end, the longitudinal axes of the first and second terminals being parallel and the insertion members and receiving members facing in a same direction when the terminals are in a first, electrically un-mated configuration, wherein rotating the second terminal ninety degrees about the longitudinal axis of the second terminal and turning the second terminal such that the insertion end of the second terminal insertion member and the receiving end of the second terminal receiving member face the receiving end of the first terminal receiving member and the insertion end of the first terminal insertion member, respectively, puts the terminals into a second configuration whereby the terminals are able to electrically mate.

18. The electrical wire connection system of claim 17 wherein the first terminal further comprises an additional insertion member and an additional receiving member in a side-by-side pattern, and the second terminal further comprises an additional insertion member and an additional receiving member in a side-by-side pattern, the additional insertion members and receiving members also arranged to electrically mate with each other when the second terminal is rotated and turned.

19. The electrical wire connection system of claim 17 wherein the receiving members of the first and second terminals are bowed inwardly to ensure electrical contact with the receiving members of the terminals.

20. The electrical wire connection system of claim 17 wherein the insertion member and receiving member of each of the first and second terminals form a right angle with each other.

* * * * *